United States Patent [19]

Riedesser

[11] 4,185,643

[45] Jan. 29, 1980

[54] MOUTHPIECE PAPER FOR CIGARETTES

[75] Inventor: Walter Riedesser, Neustadt, Fed. Rep. of Germany

[73] Assignee: Julius Glatz GmbH, Neidenfels, Fed. Rep. of Germany

[21] Appl. No.: 861,970

[22] Filed: Dec. 19, 1977

[30] Foreign Application Priority Data

Sep. 20, 1977 [DE] Fed. Rep. of Germany ..... 2743986

[51] Int. Cl.[2] ..... A24D 1/04

[52] U.S. Cl. ..... 131/12; 131/15 R

[58] Field of Search ..... 131/11, 12, 14, 15 R

[56] References Cited

U.S. PATENT DOCUMENTS

| | | | |
|---|---|---|---|
| 1,671,182 | 5/1928 | Eberlein et al. | 131/12 |
| 2,033,791 | 3/1936 | Sulzberge | 131/12 |
| 2,149,896 | 3/1939 | McArdle et al. | 131/12 X |
| 2,217,527 | 10/1940 | Roon | 131/12 |
| 3,460,959 | 8/1969 | Neuhaus | 131/12 |

FOREIGN PATENT DOCUMENTS

| | | | |
|---|---|---|---|
| 1811313 | 8/1970 | Fed. Rep. of Germany | 131/12 |

*Primary Examiner*—Lee S. Cohen

*Attorney, Agent, or Firm*—Orville N. Greene; Frank L. Durr

[57] ABSTRACT

In the preparation of synthetic mouthpiece paper for cigarettes which simulates cork, of the type wherein the paper has randomly distributed and formed depressions therein formed by stamping the paper and wherein the paper is densified in the depressed areas it is found that the similarity to cork is additionally improved by applying a coating of lacquer over the entire surface of the paper whereby the luster of the depressed portions of the paper in increased while the matt luster of the remaining portions of the paper is retained.

5 Claims, 4 Drawing Figures

MOUTHPIECE PAPER FOR CIGARETTES

Figure 1:
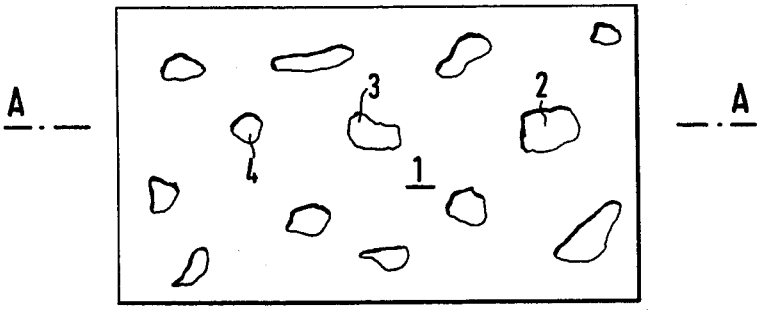

The invention relates to a mouthpiece paper for cigarettes which approaches the optimal in appearance and in the other properties to natural cork.

In German Offen. No. 1,771,150, it has already been proposed to add calcium carbonate and/or titanium dioxide as a filler for such an imitation cork paper, to introduce for coloring a suitable choice of iron oxide coloring material and to add an alkyl ketene dimer and a cationic polyalkyl amine. Thereby, there is attained an exceptionally well suited velvety surface characteristic which has the necessary high opacity of the paper and finally the necessary saliva resistance. It had also been further suggested to impress the reddish brown inked paper with random yellow dots and to use a gloss ink therefor.

In the German Offen. No. 1,811,313 it has also been suggested to stamp the paper with random pits and to give these stamped pits a glossy surface opposed to that of the usual paper surface.

On the other side, with cork mouthpiece cigarettes hazy thin peeled cork foil pieces are coated on a thin silk paper by means of a lustrous paste. In the area of the original penetration in the cork film, this paste results in an especially effective luster effect. The attainable luster effect obtained by Ger. Offen. No. 1,811,313 is not entirely the effect of mouthpieces of natural cork.

It has now been found that this luster effect can be unexpectedly substantially improved if a supplemental lacquer layer of a suitable finishing varnish is applied to the imitation cork paper for cigarette mouthpieces at the beginning of the described method. Suitable lacquers include e.g. proven shellacs, ethyl cellulose, or polyethylene wax-styrene acrylate.

These lacquers give a lustrous effect whereby the lacquer in the area of the depressed and thereby densified paper places penetrate less in the paper. Thereby, the result is a significant difference in luster to the areas surrounding the depression of the paper surface. The luster is therefore essentially stronger as opposed to the non-densified regions of the paper surface which remain in spite of the lacquer coating with a matt effect. Besides to the effect attained thereby, the paper has an astonishing likeness to the paper of natural cork foil, yields an improvement in the saliva resistance of the mouthpiece papers through the lacquer coating of the paper surface.

The amount of the introduced lacquer coating layer is in the range of 0.5 to 15 g/m$^2$ preferably 1.5 to 8 g/m$^2$.

Further features of the invention and details thereof with advantages of the same will be given in the following description in connection with the accompanying schematic drawing of an embodiment thereof shown by way of example.

In the drawing:

FIG. 1 is a cutaway plan view of mouthpiece paper.

Figure 2:
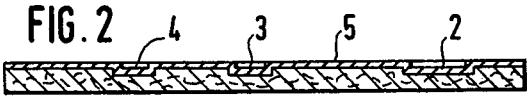
Figure 3:
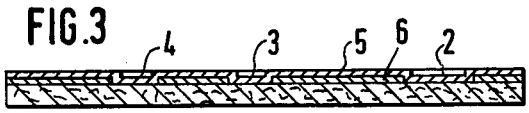
Figure 4:
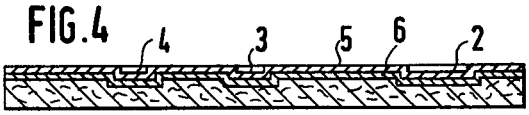

FIGS. 2, 3, and 4 are each sectional views taken along line A—A of FIG. 1 wherein each paper has a different structure and is developed according to the invention.

On the surface 1 of the paper, stampings 2,3,4, etc. are shown which, corresponding to natural cork, are of irregular form and are randomly arranged over the surface.

It does not matter whether these stampings 2,3,4 are introduced into the surface of a dyed paper (FIG. 2) or in the color layer 6 on the surface of the dyed paper, (FIG. 3), or as shown in FIG. 4 on the surface layer and the paper, these stampings yield above all from the very beginning, a glossier surface as opposed to the usual range of paper surface 1. This effect can be still further improved through the introduction, according to the invention, of the lacquer layer 5, covering the entire surface. This lacquer layer increases the lustrous effect in the stamping 2,3, and 4 and retains the remaining surface matt. In addition, this kind of lacquer layer improves the saliva resistance of the mouthpiece surface.

I claim:

1. In a mouthpiece paper for cigarettes which has the appearance and properties of cork including a dyed paper base layer having a matt luster and randomly stamped depressions on the dyed layer simulating the surface of a layer of cork, the improvement comprising a suitable lacquer layer coated over the entire surface of the dyed layer which increases the luster of the stamped depressions whereas the areas surrounding the depressions remain of a matt luster to further simulate the properties of cork.

2. Mouthpiece paper as claimed in claim 1 wherein the lacquer coating is shellac.

3. Mouthpiece paper as claimed in claim 1 wherein the lacquer coating is ethyl cellulose lacquer.

4. The mouthpiece paper as claimed in claim 1 wherein the lacquer coating is polyethylene wax-styrene acrylate.

5. Mouthpiece paper as claimed in claims 2, 3 or 4 where the amount of lacquer applied to the paper is 0.5–15 g/m$^2$.

* * * * *

UNITED STATES PATENT OFFICE

CERTIFICATE OF CORRECTION

Patent No. 4 185 643 Dated January 29, 1980

Inventor(s) Walter Riedesser

It is certified that error appears in the above-identified patent and that said Letters Patent are hereby corrected as shown below:

In the heading:

Under "Foreign Application Priority Data" should read ---- Sept. 30, 1977 [DE] Fed. Rep. of Germany 2,743,986 ----

Signed and Sealed this

First Day of July 1980

[SEAL]

Attest:

SIDNEY A. DIAMOND

Attesting Officer

Commissioner of Patents and Trademarks